US010955197B2

(12) United States Patent
Stewart et al.

(10) Patent No.: US 10,955,197 B2
(45) Date of Patent: Mar. 23, 2021

(54) STRUCTURALLY INTEGRAL HEAT EXCHANGER WITHIN A PLASTIC HOUSING

(71) Applicant: DANA CANADA CORPORATION, Oakville (CA)

(72) Inventors: Nikolas S. Stewart, Mountain View, CA (US); Lee M. Kinder, Oakville (CA)

(73) Assignee: Dana Canada Corporation, Oakville (CA)

( * ) Notice: Subject to any disclaimer, the term of this patent is extended or adjusted under 35 U.S.C. 154(b) by 92 days.

(21) Appl. No.: 16/074,525

(22) PCT Filed: Feb. 1, 2017

(86) PCT No.: PCT/CA2017/050112
§ 371 (c)(1),
(2) Date: Aug. 1, 2018

(87) PCT Pub. No.: WO2017/132761
PCT Pub. Date: Aug. 10, 2017

(65) Prior Publication Data

US 2019/0041137 A1 Feb. 7, 2019

Related U.S. Application Data

(60) Provisional application No. 62/289,593, filed on Feb. 1, 2016.

(51) Int. Cl.
*F28D 9/00* (2006.01)
*F28F 9/00* (2006.01)
(Continued)

(52) U.S. Cl.
CPC ..... *F28D 9/0043* (2013.01); *F28F 9/001* (2013.01); *F28F 21/06* (2013.01);
(Continued)

(58) Field of Classification Search
CPC ..... F28F 2275/127; F28F 2275/12; F28F 2275/125; F28F 9/002; F28F 9/001; F28D 9/0043
See application file for complete search history.

(56) References Cited

U.S. PATENT DOCUMENTS 2,029,083 A 1/1936 Prestage
2,178,095 A * 10/1939 Bowser ..... F28F 9/0265 165/174

(Continued)

OTHER PUBLICATIONS

European Patent Office, International Search Report with Written Opinion issued in PCT/CA2017/050112, dated Apr. 20, 2017, 12 pages, European Patent Office, Rijswijk, Netherlands.

*Primary Examiner* — Paul Alvare
(74) *Attorney, Agent, or Firm* — Ridout & Maybee LLP

(57) ABSTRACT

A heat exchanger having a core defining a plurality of first fluid flow passages and a plurality of second fluid flow passages arranged in alternating order, and a housing enclosing the core. The housing has a top wall arranged opposite to the top of the core, and a bottom wall arranged opposite to the bottom of the core. A plurality of connecting structures which together provide a rigid connection between the core and the housing, wherein each of the connecting structures provides a connection between the top of the core and the top wall of the housing, or between the bottom of the core and the bottom wall of the housing. Wherein each of the connecting structures has a first connecting element and a second connecting element. The first connecting element is associated with the core and the second connecting element is associated with the housing.

7 Claims, 14 Drawing Sheets

(51) Int. Cl.
*F28F 21/06* (2006.01)
*F28D 21/00* (2006.01)

(52) U.S. Cl.
CPC .. *F28D 2021/0082* (2013.01); *F28F 2225/02* (2013.01); *F28F 2275/08* (2013.01); *F28F 2275/14* (2013.01); *F28F 2275/20* (2013.01)

(56) References Cited

U.S. PATENT DOCUMENTS 2,202,493 A 5/1940 Jacocks
3,734,171 A * 5/1973 Ares ..... F24F 13/30 165/54
3,894,580 A 7/1975 Chartet
4,216,937 A * 8/1980 Bridgnell ..... F16F 15/06 165/69
4,303,052 A * 12/1981 Manfredo ..... F01P 3/18 123/563
4,355,780 A * 10/1982 Bridgnell ..... F16F 15/06 248/675
4,436,145 A * 3/1984 Manfredo ..... F02B 29/0456 123/563
4,474,162 A * 10/1984 Mason ..... F02B 29/0456 123/542
4,903,762 A * 2/1990 Marsais ..... F28D 1/05383 165/149
6,029,345 A * 2/2000 Christensen ..... B60K 11/04 165/140
7,036,562 B2 5/2006 Ayres
7,231,963 B2 6/2007 Lee
7,793,710 B2 9/2010 Lamich
8,016,025 B2 9/2011 Brost
8,282,049 B2 10/2012 Kaczmarek
8,844,306 B2 9/2014 De La Cruz
8,985,193 B2 3/2015 Hirsch
9,175,596 B2 * 11/2015 Eilemann ..... F02B 29/0462
9,502,700 B2 * 11/2016 Haussman ..... H01M 10/613
2007/0277956 A1 * 12/2007 Bergmiller ..... F28D 1/0435 165/70
2009/0013710 A1 * 1/2009 Cho ..... F25D 23/069 62/285
2012/0061052 A1 * 3/2012 Alessandrelli ..... F28F 9/0246 165/67
2012/0085515 A1 4/2012 Garcia
2012/0210986 A1 * 8/2012 Ghiani ..... F02M 26/32 123/542
2014/0000842 A1 1/2014 Gruneisen
2014/0130764 A1 * 5/2014 Saumweber ..... F28F 9/007 123/184.21
2014/0150989 A1 * 6/2014 Eindhoven ..... F28B 1/06 165/67
2014/0216385 A1 8/2014 Bruggesser
2014/0224458 A1 * 8/2014 Dornseif ..... F28F 9/0253 165/157
2014/0311143 A1 10/2014 Speidel
2014/0345577 A1 * 11/2014 Meshenky ..... F28D 9/0043 123/542
2015/0129168 A1 * 5/2015 Odillard ..... F28F 9/002 165/71
2015/0168076 A1 * 6/2015 Ferlay ..... F02B 29/0475 165/166
2015/0338167 A1 * 11/2015 Pomin ..... F28F 1/128 165/151
2016/0097596 A1 * 4/2016 Stewart ..... F28D 1/0233 165/175
2018/0066901 A1 * 3/2018 Carlson ..... F28D 1/05366

* cited by examiner

STRUCTURALLY INTEGRAL HEAT EXCHANGER WITHIN A PLASTIC HOUSING

FIELD OF THE INVENTION

The invention generally relates to heat exchangers for cooling a hot gas with a gaseous or liquid coolant, such as charge air coolers for use in motor vehicles. In particular, the invention relates to such heat exchangers having a plastic housing enclosing a metal heat exchanger core, and to improvements whereby the metal core enhances the structural rigidity of the housing.

BACKGROUND OF THE INVENTION

It is known to use gas-gas and gas-liquid heat exchangers to cool compressed charge air in supercharged or turbocharged internal combustion engines or in fuel cell engines, or to cool hot engine exhaust gases. For example, compressed charge air is typically produced by compressing ambient air. During compression, the air can be heated to a temperature of about 200° C. or higher, and must be cooled before it reaches the engine.

Various constructions of gas-cooling heat exchangers are known. For example, gas-cooling heat exchangers commonly have an aluminum core comprised of a stack of tubes or plates, with each tube or pair of plates defining an internal coolant passage for a gaseous or liquid coolant. The tubes or plate pairs are spaced apart to define gas flow passages which are typically provided with turbulence-enhancing inserts to improve heat transfer from the hot gas to the coolant.

According to a known construction for use in supercharged or turbocharged internal combustion engines, a metal heat exchanger core is enclosed within a housing which is at least partially comprised of plastic, and which may comprise an inlet duct or inlet manifold of the engine. Portions of the plastic housing are subject to high loads due to the elevated pressure and temperature of the charge air entering the heat exchanger, and additional support is required in these areas.

For example, it is known to include reinforcing corrugations and/or ribs in a plastic charge air duct or intake manifold for an internal combustion engine, as disclosed in US 2014/0311143 A1 (Speidel et al.) and US 2014/0216385 A1 (Bruggesser et al.). These corrugations and ribs are typically provided in the walls of the housing located above and below the heat exchanger core, which tend to be large unsupported areas. One disadvantage of such corrugations and/or ribs is that they can increase the thickness of the top and/or bottom wall of the housing by as much as 10-20 mm. Since the housing will typically be contained within a finite packaging space, the increased thickness of the top and bottom walls may reduce the amount of space available for the heat exchanger core, and can therefore negatively affect the performance of the heat exchanger.

It is also known to support the top and bottom walls of the heat exchanger housing by passing bolts or tie rods completely through the heat exchanger core and the unsupported top and bottom walls of the housing as disclosed, for example, in US 2014/0130764 A1 (Saumweber et al.). In alternative embodiments disclosed by Saumweber et al., the tie rods are replaced by profile bars provided on the top and bottom of the heat exchanger or by projections provided on the housing. This type of construction may reduce the need to provide reinforcing corrugations and/or ribs in the housing, but is not entirely satisfactory. For example, the provision of tie rods through the heat exchanger core complicates the construction of the heat exchanger core and increases the number of potential leak paths in the core. Also, the provision of profile bars on the top and bottom of the heat exchanger is limited to applications where the heat exchanger is assembled by sliding the core into the housing.

The use of metal in the top and bottom walls of the housing can reduce or eliminate the need for the additional supports which are needed in a plastic housing. Accordingly, charge air coolers are provided with composite housings in which a thin aluminum casing encloses the heat exchanger core, with plastic inlet and outlet tank portions attached to the metal casing by crimping. However, this type of housing construction is typically used with cores having a tube-to-header construction in which the width of the tubes is fixed. This type of core construction has limited flexibility, since the fixed tube width requires that tubes are added in multiples in order to alter the performance of the heat exchanger for different applications.

There remains a need for gas-cooling heat exchangers comprising a metal core within a plastic housing in which the heat exchanger core provides structural rigidity to the housing without the disadvantages discussed above.

SUMMARY OF THE INVENTION

In one aspect, there is provided a heat exchanger comprising: (a) a core defining a plurality of first fluid flow passages and a plurality of second fluid flow passages arranged in alternating order, wherein the core is comprised of metal and has a top and a bottom; (b) a housing enclosing the core, the housing having a top wall arranged opposite to the top of the core, and a bottom wall arranged opposite to the bottom of the core, wherein at least the top wall and the bottom wall of the housing are comprised of plastic; (c) a plurality of connecting structures which together provide a rigid connection between the core and the housing, wherein each of the connecting structures provides a connection between the top of the core and the top wall of the housing, or between the bottom of the core and the bottom wall of the housing; wherein each of the connecting structures comprises a first connecting element and a second connecting element, wherein the first connecting element is associated with the core and the second connecting element is associated with the housing.

In an embodiment, the first and second connecting elements each comprise either a projecting portion or a receiving portion. In an embodiment, the projecting portion is received in the receiving portion. In an embodiment, the projecting portion and the receiving portion are secured together.

In an embodiment, the receiving portion comprises a recess or aperture in the top or the bottom of the core, or a recess or aperture in the top wall or the bottom wall of the housing. In an embodiment, each of the receiving portions comprises a recess or aperture in the top or the bottom of the core, and each of the projecting portions extends from the top wall or the bottom wall of the housing to the receiving portion. In an alternate embodiment, each of the receiving portions comprises a recess or aperture in the top wall or the bottom wall of the housing, and each of the projecting portions extends from the top or the bottom of the core to the receiving portion.

In an embodiment, the top of the core is defined by a top plate and the bottom of the core is defined by a bottom plate. In an embodiment, each of the receiving portions comprises a recess or aperture in either the top plate or the bottom plate, wherein each said recess or aperture is undercut so as to increase in area in a direction from the top wall or bottom wall of the housing toward the opposed top or bottom of the core. In an embodiment, each of the receiving portions comprises an aperture through the top plate or the bottom plate. In an embodiment, the top plate and/or the bottom plate is of composite construction, comprising a first and second apertured plates, wherein the first apertured plate includes a plurality of first apertures of a first area, and the second apertured plate includes a plurality of second apertures of a second area, wherein the first and second apertures are in registration when the first and second plates are combined to form said top plate or bottom plate, and wherein the first apertures are of greater area than the second apertures.

In an embodiment, the core comprises a plurality of plate pairs, each of the plate pairs defining one of said second fluid flow passages and comprising a first core plate and a second core plate, the plate pairs being separated by spaces which define said first fluid flow passages, said first fluid flow passages having an inlet and an outlet; and wherein said housing has a first fluid inlet opening and a first fluid inlet manifold to supply the first fluid to the inlet of the first fluid flow passages, and the housing has a first fluid outlet opening and a first fluid outlet manifold to receive the first fluid from the outlet of the first fluid flow passages.

In an embodiment, the top plate and the bottom plate are each thicker than one of the core plates.

In an embodiment, the housing comprises a plurality of segments.

In another aspect, there is provided a method for manufacturing a heat exchanger comprising a core and a housing enclosing the core, and further comprising a plurality of connecting structures which together provide a rigid connection between the core and the housing, wherein each of the connecting structures comprises a first connecting element associated with the core and a second connecting element associated with the housing. The method comprises: (a) providing said core, the core defining a plurality of first fluid flow passages and a plurality of second fluid flow passages arranged in alternating order, wherein the core is comprised of metal and has a top and a bottom; providing said housing, the housing having a top wall and a bottom wall and comprising a first segment and a second segment; (c) moving at least one of the first segment and the second segment of the housing toward one another along an assembly axis while the core is situated between them, such that: (i) the first and second segments of the housing are brought into engagement with one another to assemble the housing over the core, such that the top wall of the housing is arranged opposite to the top of the core and the bottom wall of the housing is arranged opposite to the bottom of the core; and (ii) each of the first connecting elements of the core is brought into engagement with one of the second connecting elements of the housing; (d) securing together the first and second segments of the housing; and (e) securing together the first and second connecting elements of the connecting structures.

In an embodiment, the assembly axis is perpendicular to the top and the bottom of the core, such that the top wall of the housing is provided in the first segment and the bottom wall of the housing is provided in the second segment.

In an embodiment, the assembly axis is parallel to the top and the bottom of the core, such that the first and second segments of the housing each include a portion of the top wall and a portion of the bottom wall.

In an embodiment, the first and second segments of the housing are secured together by one or more of welding and mechanical fasteners.

In an embodiment, the step of securing together the first and second connecting elements of the connecting structures includes deforming the second connecting elements so as to provide an interlocking fit between the first and second connecting elements.

In an embodiment, said deforming comprises heating and softening portions of the second connecting elements which are engaged with the first connecting elements.

In an embodiment, the step of securing together the first and second connecting elements of the connecting structures comprises mechanically fastening the first and second connecting elements.

BRIEF DESCRIPTION OF THE DRAWINGS

The embodiments will now be described, by way of example only, with reference to the accompanying drawings in which.

DETAILED DESCRIPTION

A heat exchanger 10 according to a first embodiment is now described below with reference to FIGS. 1 to 9.

Figure 1:
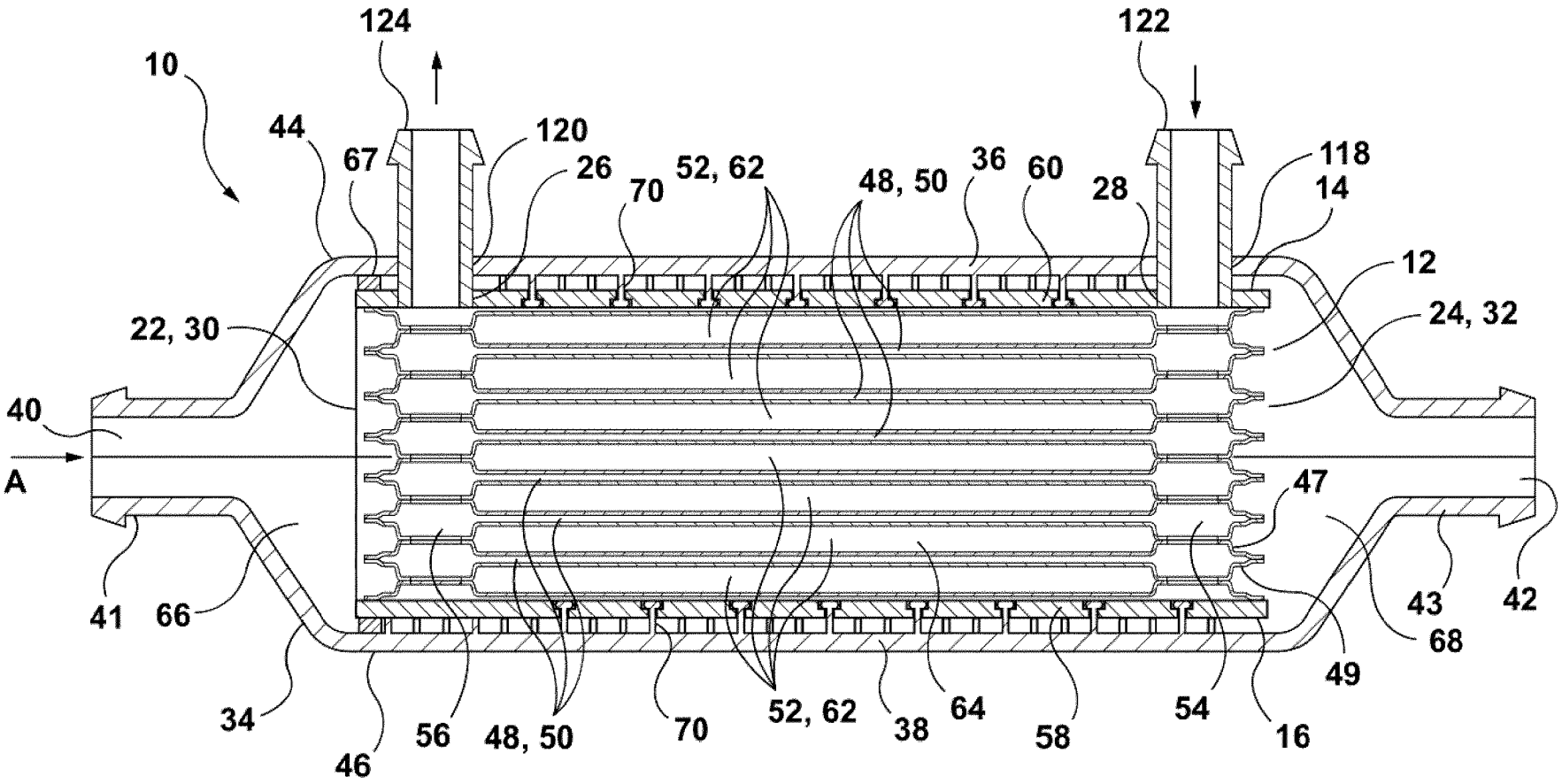
FIG. 1 is a longitudinal cross-section through a heat exchanger according to a first embodiment.
Figure 2:
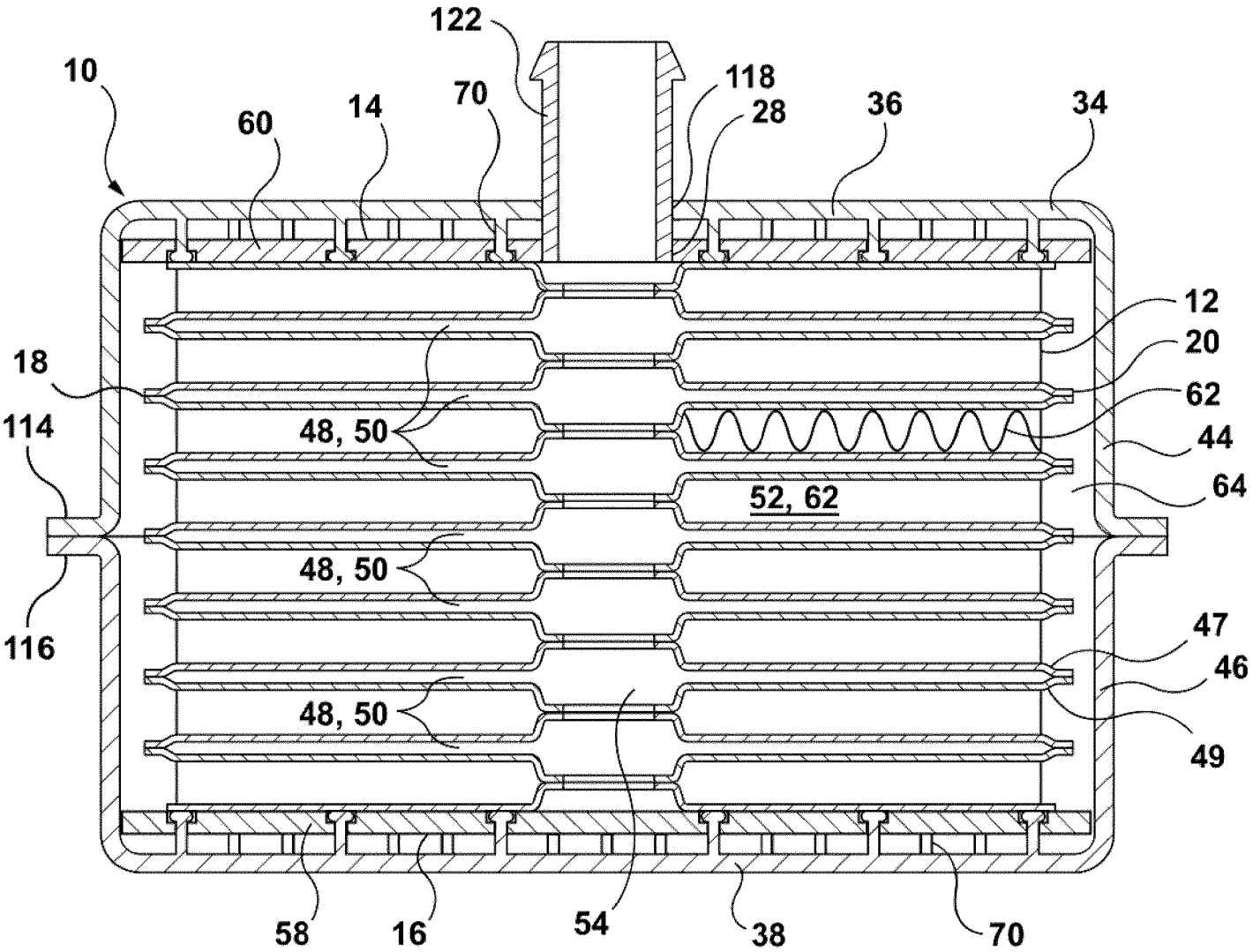
FIG. 2 is a transverse cross-section through the heat exchanger of FIG. 1.
Figure 3:
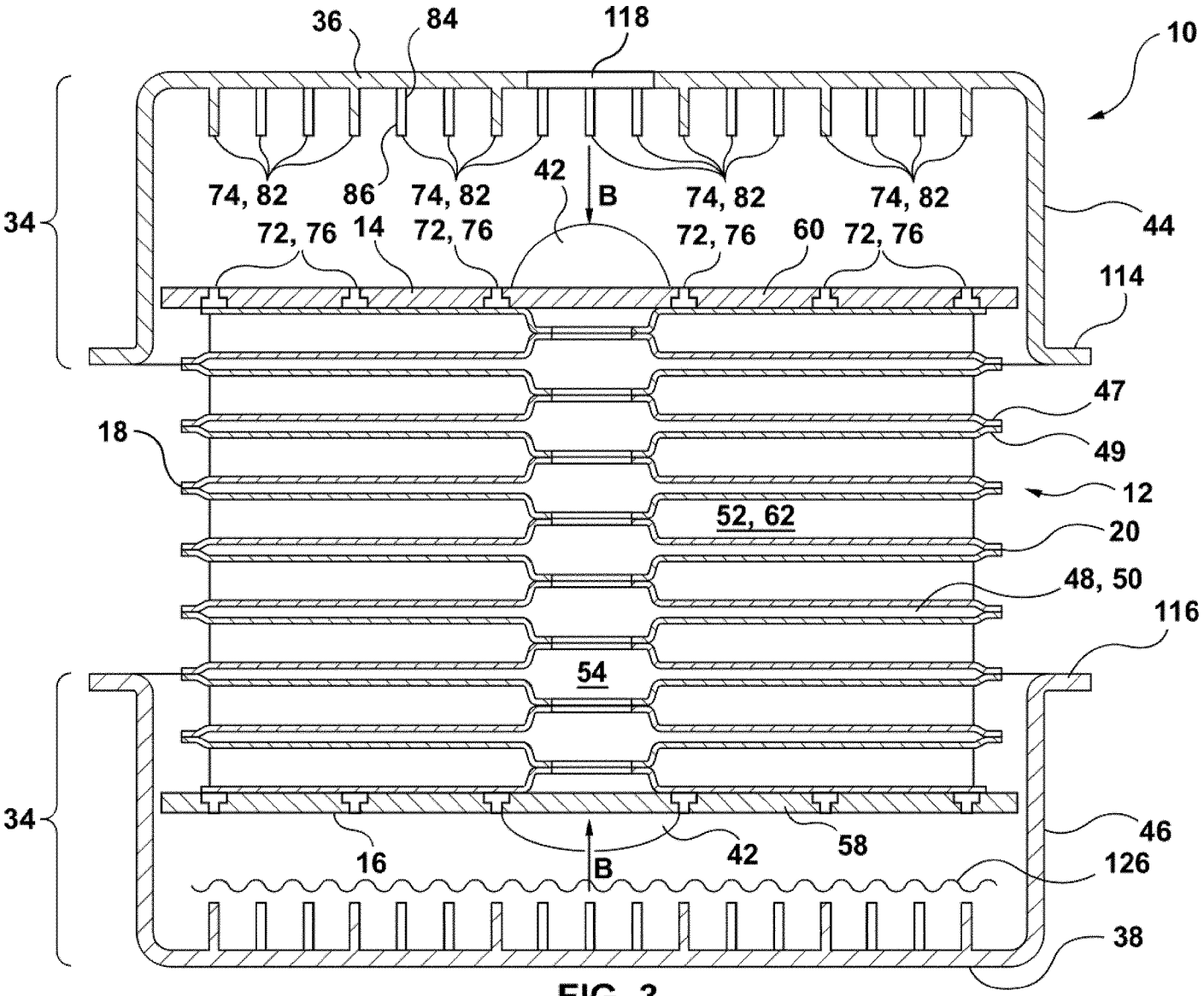
FIG. 3 is a transverse cross-section through the heat exchanger of FIG. 1, showing the assembly of the housing over the core.

As shown in FIGS. 1 to 3, heat exchanger 10 comprises a core 12 having a top 14, a bottom 16, a pair of sides 18, 20, a first end 22 defining an inlet 30 for a first fluid, a second end 24 defining an outlet 32 for the first fluid, and respective inlet and outlet openings 26, 28 for a second fluid. The core 12 defines a plurality of first fluid flow passages 52 and a plurality of second fluid flow passages 50 arranged in alternating order.

The core 12 of heat exchanger 10 is comprised of metal. For example, the core 12 may be comprised of aluminum or an aluminum alloy, with the components of core 12 being rigidly joined together by brazing. As used herein, the term "aluminum" is intended to include aluminum and its alloys.

Heat exchanger 10 further comprises a housing 34 at least partially surrounding the core 12. The housing 34 comprises at least a top wall 36 arranged in opposed spaced relation to the top 14 of core 12, and a bottom wall 38 arranged in opposed spaced relation to the bottom 16 of core 12. At least the top wall 36 and bottom wall 38 of housing 34 are comprised of an organic polymeric material (i.e. "plastic") able to withstand the elevated service temperatures to which the heat exchanger 10 will be exposed. In the embodiments described herein the entire housing 34 is comprised of plastic, for example a thermoplastic.

The housing 34 includes a first fluid inlet opening 40 communicating with the first fluid inlet opening 30 of core 12, and also includes a first fluid inlet fitting 41 for direct or indirect connection to an upstream component of a vehicle engine system. The housing 34 includes a first fluid outlet opening 42 communicating with the first fluid outlet opening 32 of core 12, and also includes a first fluid outlet fitting 43 for direct or indirect connection to a downstream component of a vehicle engine system.

The interior of the housing 34 includes three chambers, a first chamber 64 in which the core 12 is received between the top wall 36 and bottom wall 38 of the housing 34; a second chamber 66, also referred to herein as "inlet chamber 66", located between the first fluid inlet opening 40 of housing 34 and the first fluid inlet opening 30 of core 12; and a third chamber 68, also referred to herein as "outlet chamber 68", located between the first fluid outlet opening 42 of housing 34 and the first fluid outlet opening 32 of core 12. The inlet chamber 66 provides an inlet manifold space in which first fluid entering heat exchanger 10 through first fluid inlet opening 40 of housing 34 is distributed across the area of the first fluid inlet opening 30 of core 12. Similarly, the outlet chamber 68 provides an outlet manifold space in which first fluid discharged from the first fluid outlet opening 32 of core 12 is collected before exiting the housing 34 through the first fluid outlet opening 32.

As will be discussed further below, the housing 34 is comprised of at least two segments, including a first segment 44 and a second segment 46 which are sealingly joined together along their respective connecting flanges 114, 116. The housing 34 also includes inlet and outlet openings 118, 120 and inlet and outlet fittings 122, 124 for the second fluid, as will be further described below.

In the embodiments described herein, heat exchanger 10 may comprise a charge air cooler or intercooler located between an air compressor (i.e. the upstream component of the vehicle engine system) and an intake manifold (i.e. the downstream component of the vehicle engine system) in a motor vehicle powered by an engine requiring compressed charge air, such as a supercharged internal combustion engine, a turbocharged internal combustion engine or a fuel cell engine. In some embodiments, the heat exchanger 10 may be integrally formed with the intake manifold of the motor vehicle, for example as described in the above-mentioned publication by Speidel et al.

The heat exchanger 10 described herein may be a liquid-to-air charge air cooler, in which case the first fluid is hot, pressurized air produced by the vehicle's air compressor and the second fluid is a liquid coolant which may be the same as the engine coolant, for example water or a water/glycol mixture. In other embodiments, the heat exchanger 10 may comprise a gas-to-gas charge air cooler, in which the first fluid is hot, pressurized air and the second fluid may be ambient air or, in the case of a fuel cell engine, a waste gas from the fuel cell stack. In other embodiments, the heat exchanger 10 may comprise an engine oil cooler, in which case the first fluid is hot engine or transmission oil, and the second fluid is a liquid engine coolant.

It will be appreciated that the specific arrangement and locations of the inlet and outlet openings for the first and second fluids will at least partially depend on the specific configuration of a vehicle's air intake system, and will vary from one application to another.

The structure of the core 12 is variable, and the specific construction described herein and shown in the drawings is only one example of a possible core construction. The structure of core 12 is best seen in the cross-sectional views of FIGS. 1 to 3. Core 12 comprises a stack of flat tubes 48, each of the tubes 48 having a hollow interior defining a coolant flow passage 50. The tubes 48 may be of various constructions, and in the present embodiment are each comprised of a first core plate 47 and a second core plate 49 joined together in face-to-face relationship, and sealingly joined together by brazing along their peripheral flanges. Accordingly, the tubes are sometimes referred to herein as "plate pairs", and the same reference numeral 48 is used herein to identify both tubes and plate pairs.

The tubes 48 are spaced apart from one another, with first fluid flow passages 52 being defined between adjacent tubes 48. The first fluid flow passages 52 extend from the inlet end 22 to the outlet end 24 of core 12, and the direction of gas flow through the core 12 is illustrated by longitudinal axis A in FIG. 1. The spaces between adjacent tubes 48 are open at the first end 22 and the second end 24 of core 12, and the open ends of these spaces collectively define the respective inlet 30 and outlet 32 for the first fluid.

The first fluid flow passages 52 may be provided with turbulence-enhancing inserts 62 such as corrugated fins or turbulizers in order to provide increased turbulence and surface area for heat transfer, and to provide structural support for the core 12. The corrugated fins and turbulizers are only schematically shown in the drawings.

As used herein, the terms "fin" and "turbulizer" are intended to refer to corrugated turbulence-enhancing inserts having a plurality of axially-extending ridges or crests connected by side walls, with the ridges being rounded or flat. As defined herein, a "fin" has continuous ridges whereas a "turbulizer" has ridges which are interrupted along their length, so that axial flow through the turbulizer is tortuous. Turbulizers are sometimes referred to as offset or lanced strip fins, and examples of such turbulizers are described in U.S. Pat. No. Re. 35,890 (So) and U.S. Pat. No. 6,273,183 (So et al.). The patents to So and So et al. are incorporated herein by reference in their entireties. For the purpose of illustration, the corrugated structure of a turbulence-enhancing insert 62 in the form of a fin is schematically shown in FIG. 2, although it will be appreciated that the spacing of the corrugations will typically be less than that which is shown in FIG. 2. As shown in FIG. 2, the turbulence-enhancing insert 62 is oriented such that the openings defined by the corrugations are facing the direction of flow of the first fluid.

The second fluid flow passages 50 of core 12 are connected by a pair of second fluid manifolds, namely a second fluid inlet manifold 54 and a second fluid outlet manifold 56. In the present embodiment, the manifolds 54, 56 are formed by providing apertured, upstanding bosses or bubbles in each of the core plates 47, 49 making up the tubes 48, with the bosses of adjacent plate pairs 48 being joined to form continuous manifolds 54, 56. The manifolds 54, 56 are in communication with each of the second fluid flow passages 50 and extend throughout the height of the core 12, from the top 14 to the bottom 16.

The top 14 of core 12 is defined by a top plate 60 and the bottom 16 of core 12 is defined by a bottom plate 58. The bottom plate 58 and top plate 60 are each brazed to one of the core plates 47 or 49 in the core 12, and may be comprised of thicker metal than core plates 47, 49 in order to provide structural rigidity to the core 12. Alternatively, the top and bottom plates 60, 58 may be joined to the turbulence-enhancing inserts 62 of the uppermost and lowermost first gas flow passages 52, respectively. In the present embodiment, the lower ends of manifolds 54, 56 are closed by the bottom plate 58, while the inlet 26 and outlet openings 28 for the second fluid are defined in the top plate 60.

The arrangement of the inlet and outlet openings 26, 28 and manifolds 56, 58 in core 12 are variable, and depend on the specific configuration of heat exchanger 10. For example, the second fluid inlet and outlet manifolds 54, 56 may be spaced apart along the direction of gas flow A, such that the first and second fluids are in co-flow or in counter-flow with one another. Alternatively, the manifolds 54, 56 may both be located adjacent to the same end 22 or 24 of core 12, such that the second fluid flow passages 50 are U-shaped. Also, one or both of the inlet and outlet openings 26, 28 for the second fluid may be provided in the bottom plate 58 rather than in the top plate 60.

Any gaps between the housing 34 and the outer periphery of core 12 can be sealed by an elastomeric sealing member, such as sealing member 67 shown in FIG. 1. The provision of seal 67 reduces or eliminates any bypass flow of the first fluid between the core 12 and housing 34, which will negatively affect performance of heat exchanger 10.

Heat exchanger 10 further comprises a plurality of connecting structures 70 which together provide a rigid connection between the core 12 and the housing 34. These rigid connections between the core 12 and housing 34 allow the rigid metal core 12 to provide the housing 34 with additional structural rigidity, to permit the housing 34 to resist the high pressure and temperature of the first fluid without significant deformation.

Each of the connecting structures 70 provides a connection between the top 14 of the core 12 and the top wall 36 of housing 34, or between the bottom 16 of the core 12 and the bottom wall 38 of housing 34. The added structural rigidity provided by connecting structures 70 provides support for the top wall 36 and bottom wall 38 of the housing 34, thereby avoiding the need to increase the thickness of the housing 34 so as to accommodate reinforcing ribs and corrugations, and avoiding the need to pass bolts or tie rods completely through the heat exchanger core 12 and the top and bottom walls 36, 38 of the housing 34. Thus, the use of connecting structures 70 permits the size of the heat exchanger core 12 to be maximized the performance of the heat exchanger 10, while avoiding the creation of additional leak paths through the core 12.

Each of the connecting structures 70 comprises a first connecting element 72 and a second connecting element 74, wherein the first connecting element is associated with the core 12 and the second connecting element 74 is associated with the housing 34. Within the context of the embodiments discussed herein, the term "associated with" is interpreted as meaning attached to, integrally formed with, projecting from, and/or formed in or through.

For example, in the first embodiment, the first and second connecting elements 72, 74 are integrally formed with the core 12 and the housing 34, respectively, and each comprises either a projecting portion or a receiving portion as described further below.

Also in the first embodiment, each of the first connecting elements 72 comprises a recess or aperture in either the bottom plate 58 or the top plate 60 of core 12. Each recess or aperture is undercut so that it increases in area in a direction toward the core 12, i.e. in a direction from the top wall 36 of the housing 34 toward the top 14 of the core 12, or in a direction from the bottom wall 38 of the housing 34 toward the bottom 16 of the core 12.

Referring specifically to the drawings, each of the first connecting elements 72 in heat exchanger 10 comprises a circular aperture 76 extending completely through either the bottom plate 58 or top plate 60. Each aperture 76 has a "stepped" configuration, including a first bore 78 on one side of the bottom plate or top plate 58, 60 and a second bore 80 on the opposite side of plate 58, 60, wherein the first bore 78 is of greater diameter and area than the second bore 80. The larger first bore 78 is open to the side of bottom plate 58 or top plate 60 which faces the core 12, while the smaller second bore 80 is open to the opposite side of bottom plate 58 or top plate 60. In the illustrated embodiment the two bores 78, 80 are concentric.

Instead of having the stepped configuration shown in the drawings, the apertures 76 may have a frustoconical or countersink configuration, with a smoothly tapering inner wall extending from a smaller opening on one side of plate 58, 60 to a larger opening on the opposite side.

In the first embodiment, each of the second connecting elements 74 comprises a projecting portion which extends from either the top wall 36 or the bottom wall 38 of the housing 34 to one of the receiving portions, with the projecting portion being received in and secured to one of the receiving portions which comprise the first connecting elements 72 described above.

With specific reference to the drawings, each of the second connecting elements 74 comprises an elongate projection 82, also referred to herein as finger 82. Each finger 82 has first end 84 which is integrally formed with and attached to an inside surface of either the top wall 36 or bottom wall 38 of housing 34, with an opposite second end 86 which is secured inside one of the apertures 76 of the bottom plate 58 or top plate 60.

Figure 6:
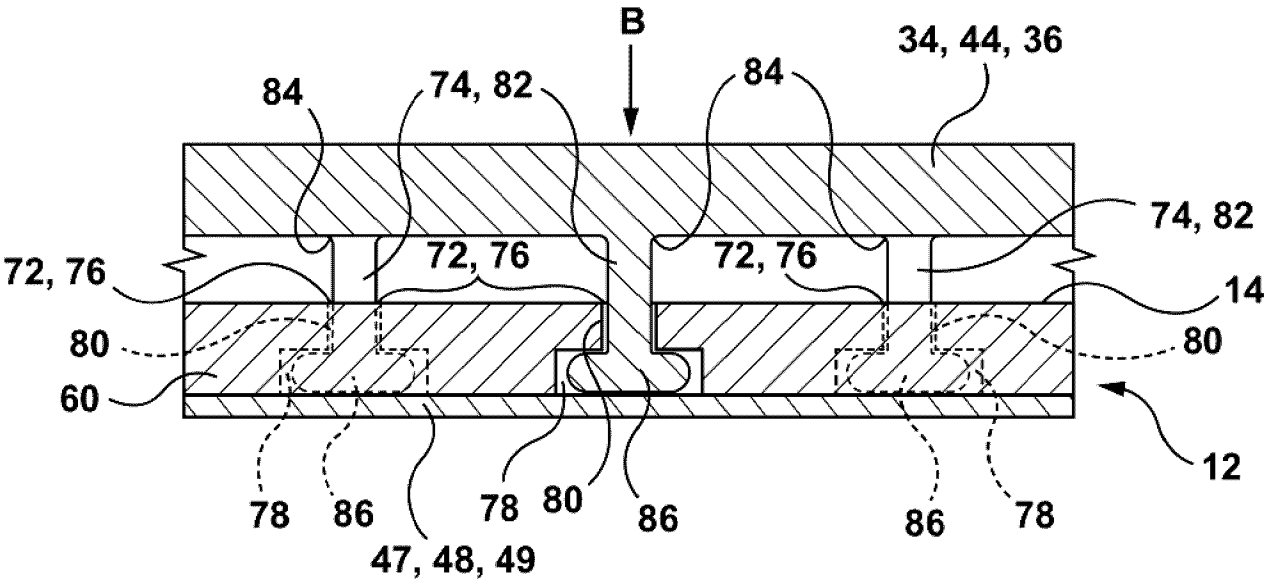
FIG. 6 is a view of the connecting structure of FIG. 4, in a secured state.

It can be seen from FIGS. 1, 2 and 6 that the second ends 86 of the fingers 82 are expanded to a size which is larger than the size (i.e. diameter and/or area) of the aperture 76 at the side of the bottom plate 58 or top plate 60 which faces the opposed bottom wall 38 or top wall 36 of housing 34. In the specific configuration shown in FIGS. 1, 2 and 6, the expanded second end 86 of each finger 82 is trapped within the larger first bore 78 of an aperture 76, and is too large to be withdrawn through the smaller second bore 80.

A method of manufacturing the heat exchanger 10 is now described below with reference to FIGS. 3 to 6.

As mentioned above, the housing 34 comprises a first segment 44 and a second segment 46. In the present embodiment, the first segment 44 is the top segment which includes the top wall 36 of housing 34, and the second segment 46 is the bottom segment which includes the bottom wall 38 of housing 34. In the present embodiment the first and second segments are shown as being of approximately the same size and shape; however, this is not necessarily the case and will depend on the specific application.

FIG. 3 shows the top and bottom segments 44, 46 of housing 34 spaced apart from one another along an assembly axis B, with the core 12 being situated between the segments 44, 46 and oriented with the top 14 of core 12 facing the top wall 36 of housing 34, and the bottom 16 of core 12 facing the bottom wall 38 of housing 34. For convenience, the second fluid inlet fitting 122 is eliminated from FIG. 3. The housing 34 is assembled over the core 12 by moving at least one of the first and second segments 44, 46 toward one another along the assembly axis B. The movement of segments 44 and/or 46 toward one another is continued until the segments 44 and 46 are brought into engagement with one another along their respective connecting flanges 114, 116, and until each of the first connecting elements 72 of the core 12 is brought into engagement with and secured to one of the second connecting elements 74 of the housing 34.

Figure 4:
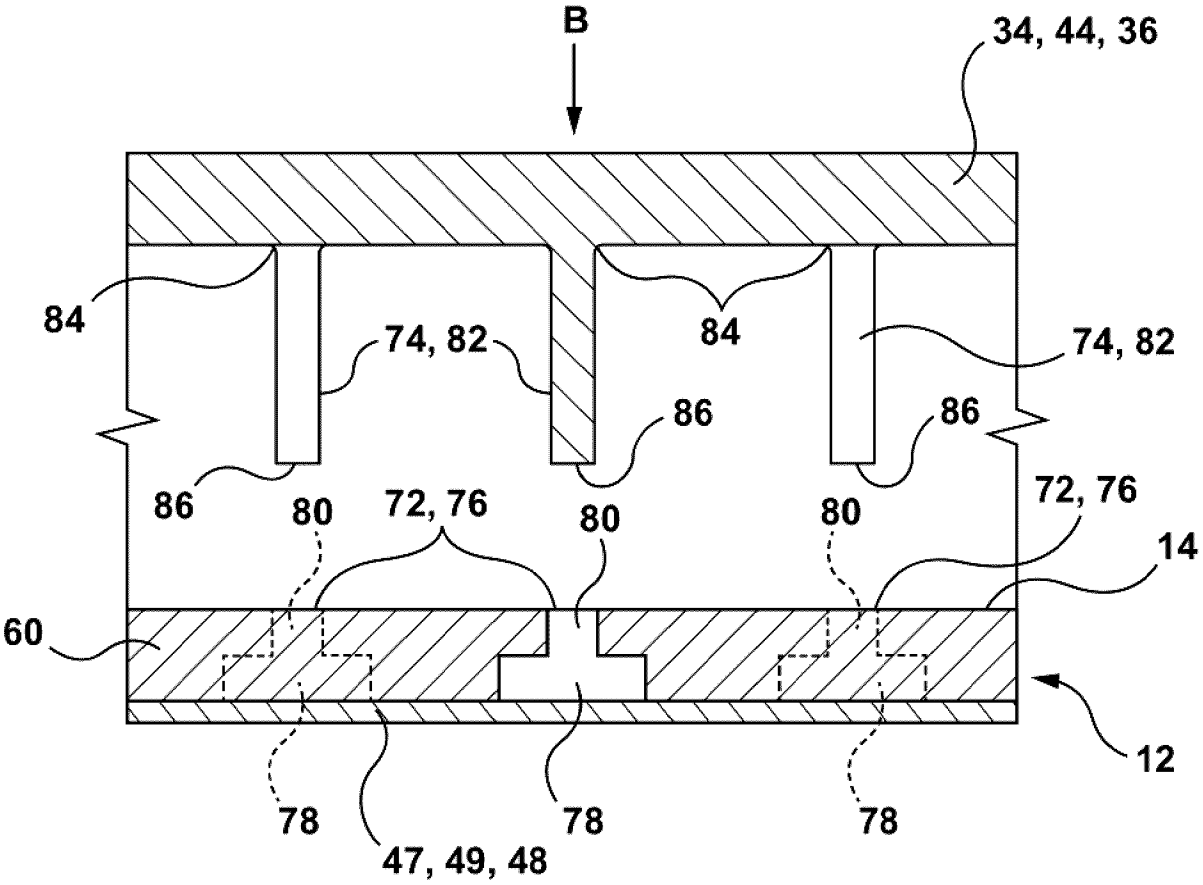
FIG. 4 is a partial, enlarged transverse cross section showing the elements of the connecting structure in the heat exchanger of FIG. 1, in an unsecured state.

FIGS. 3 and 4 each show the connecting structures 70 in a pre-assembled state, with the second ends 86 of fingers 82 being free ends which are spaced apart from the apertures 76 of the opposed bottom plate 58 or top plate 60. At this stage of the method, the second ends 86 of fingers 82 are of a size which will permit them to fit through the smaller sides of apertures 76, i.e. the second bore 80 in FIGS. 3 and 4. For example, as shown, the fingers 82 may be of substantially constant diameter or area from their first ends 84 to their second ends 86. Further, the fingers 82 may have a cylindrical cross-section fit within the circular shape of apertures 76.

Figure 5:
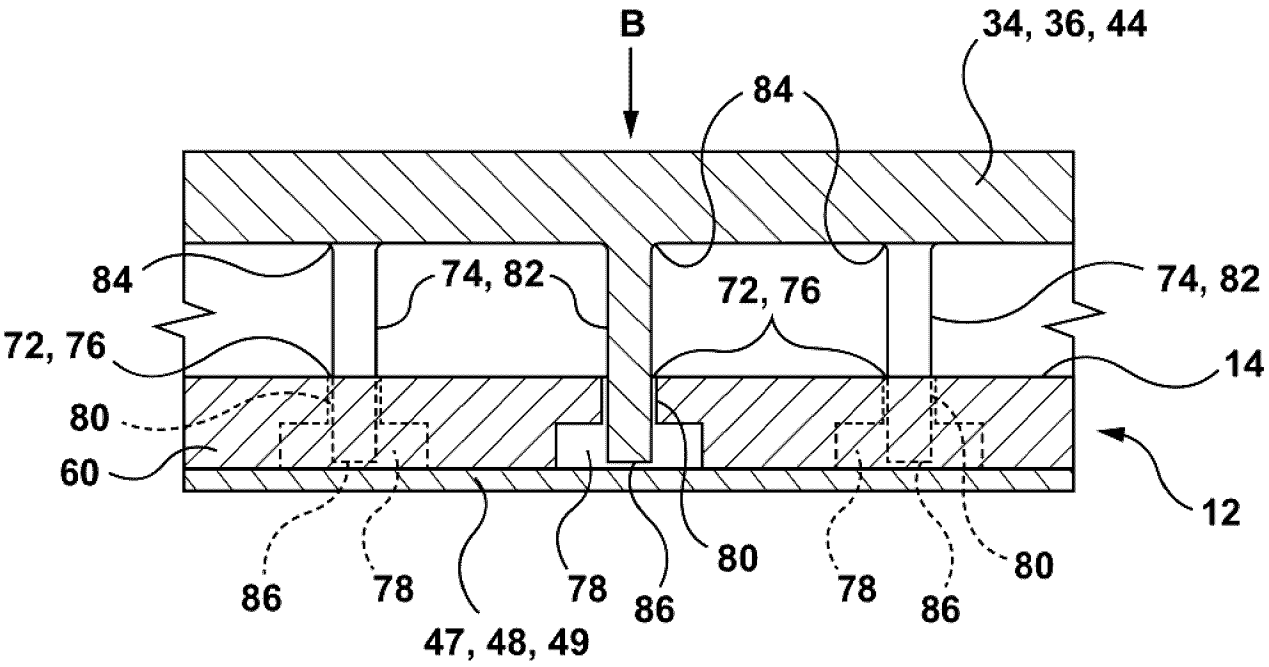
FIG. 5 is a view of the connecting structure of FIG. 4, in an intermediate state.

FIG. 5 shows an intermediate configuration of the connecting structures 70. At this stage of the method, the first and second segments 44, 46 have been moved toward one another along the assembly axis B to a point at which the second ends 86 of fingers 82 have been inserted at least part way into the apertures 76 of the bottom plate 58 or top plate 60. At this point, the second ends 86 of fingers 82 are still of a size which will permit them to fit through the smaller sides of apertures 76, and therefore the fingers 82 are not yet secured inside the apertures 76. At this stage of the method, the connecting flanges 114, 116 of segments 44, 46 may be slightly spaced apart from one another.

FIG. 6 shows the final configuration of the connecting structures 70, with the second ends 86 of fingers 82 having been expanded to a size which is larger than the size of the aperture 76 at the side of the bottom plate 58 or top plate 60 which faces the opposed bottom wall 38 or top wall 36 of housing 34. In the specific configuration shown in FIGS. 1, 2 and 6, the expanded second end 86 of each finger 82 is trapped within the larger first bore 78 of an aperture 76, and is too large to be withdrawn through the smaller second bore 80, such that the first and second connecting elements 72, 74 are secured together.

The expansion of the second ends 86 of fingers 82 can be accomplished in various ways. For example, where the housing 34 is comprised of a thermoplastic, the second ends 86 of fingers 82 can be softened by heating either immediately before and/or during movement of the segments 44, 46 toward one another along the assembly axis B. Heating can be accomplished by induction, or by contacting the second ends 86 of fingers 82 with a hot gas or a heated plate. The application of heat the second ends 86 of fingers 82 is represented by wavy line 126 in FIG. 3.

The softened second ends 86 may be deformed into the expanded shape shown in FIGS. 1, 2 and 6 by applying a compressive force to the fingers 82 while the second ends 86 are in a softened state. Compression can be applied by continued movement of the segments 44 and/or 46 toward one another along axis B after the fingers 82 have been inserted into apertures 76. Therefore, the fingers 82 are of sufficient length that they will extend completely into apertures 76 before the connecting flanges 114, 116 of the segments 44, 46 are brought into engagement with one another. By comparing FIGS. 5 and 6, one can see that the distance between the top wall 36 of housing 34 is reduced by compression and deformation of the second ends 86 of fingers 82.

Once the connecting flanges 114, 116 of the segments 44, 46 are in engagement with one another, they are sealingly joined together by any suitable means, such as mechanically or by welding.

Figure 7:
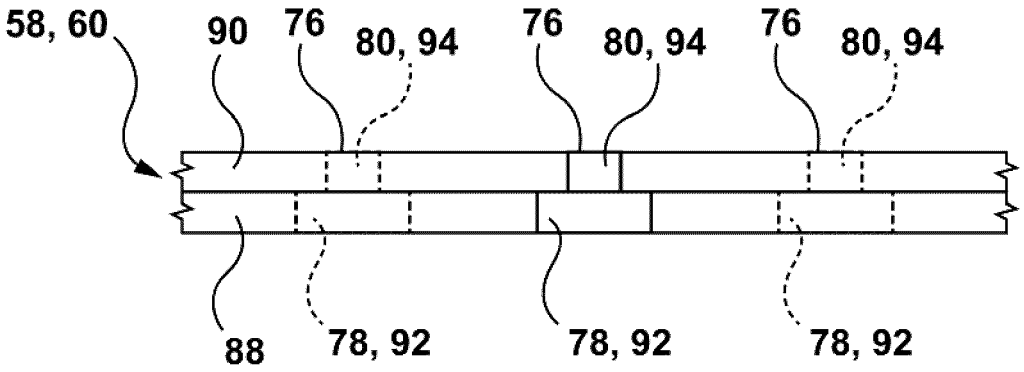
FIG. 7 is a partial, cross-sectional side view of an alternate top or bottom plate having a composite construction.
Figure 8:
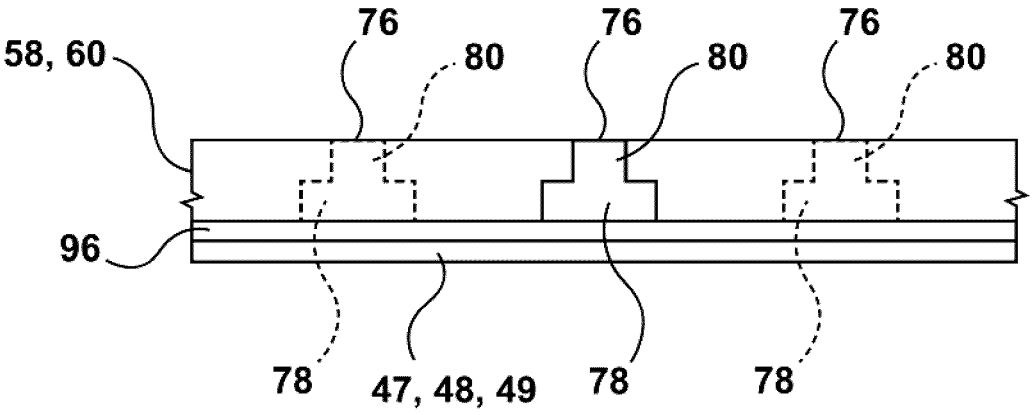
FIG. 8 is a partial, cross-sectional side view of an alternate top or bottom plate, comprising an intermediate sealing plate.

FIGS. 7 and 8 show alternate configurations of bottom plate 58 or top plate 60. In FIG. 7, the bottom plate 58 and/or the top plate 60 is of a composite construction, comprising first and second apertured plates 88, 90 which are sealingly secured together, for example by brazing. The first apertured plate 88 includes a plurality of first apertures 92 of a first diameter and/or area, and the second apertured plate 90 includes a plurality of second apertures 94 of a second diameter and/or area. The first and second apertures 92, 94 are in registration with one another when the first and second plates 88, 90 are stacked, with the first apertures 92 being of greater area than the second apertures 94. The term "in registration" means that the first and second apertures 92, 94 are concentric or substantially concentric, within acceptable manufacturing tolerances. When assembled to form the bottom plate 58 or top plate 60, the first apertures 92 form the first bore 78 of aperture 76, and the second apertures 94 form the second bore 80.

In FIG. 8 an intermediate plate 96 is provided between the bottom plate 58 and/or the top plate 60, to seal the larger bores 78 of apertures 76 which are in contact with the core 12. This permits the apertures 76 to be provided over areas of the bottom plate 58 and/or the top plate 60 which seal the second fluid manifolds 54, 56, without the risk of the second fluid leaking through the apertures 76.

Figure 9:
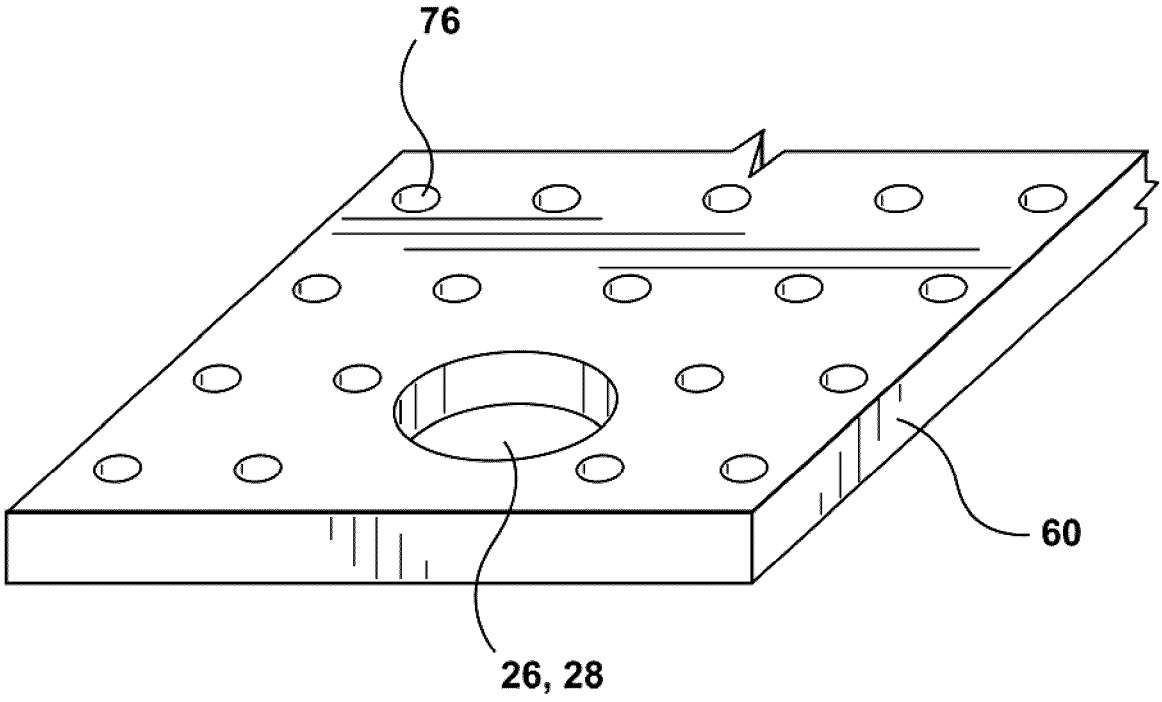
FIG. 9 is a partial, top perspective view of a top or bottom plate of the heat exchanger of FIG. 1.

FIG. 9 shows a top plate 60 having a second fluid inlet or outlet 26, 28, and having apertures 76 distributed over the remainder of the top plate 60.

A heat exchanger 200 according to a second embodiment is now described below with reference to FIGS. 10 and 11. Heat exchanger 200 includes a number of elements in common with heat exchanger 10 described above, and these like elements are identified with like reference numerals, and the above description of these like elements in connection with heat exchanger 10 applies equally to the elements of heat exchanger 200.

The core 12 of heat exchanger 200 is identical to the core 12 of heat exchanger 10 described above, with the exception of the bottom plate 58 and top plate 60. Therefore, a detailed description of core 12 is omitted from the following discussion. Also, the housing 34 of heat exchanger 200 includes a first segment 44 in which the top wall 36 is provided, and a second segment 46 in which the bottom wall 38 is provided, with the two segments 44, 46 being sealingly joined together along their respective connecting flanges 114, 116. The arrangement of inlet openings 40, 42 and fittings 41, 43 for the first fluid in heat exchanger 200 are substantially the same as for heat exchanger 10. While the openings and fittings for the second fluid provided in the bottom plate 58, top plate 60 and housing 34 are not shown in FIG. 10, it will be appreciated that the configurations of these elements will be the generally the same as in heat exchanger 10, due to the locations of the second fluid inlet and outlet manifolds 54, 56 in heat exchanger 200.

The following description of heat exchanger 200 will focus on the construction of connecting structures 70, which differs somewhat from that of heat exchanger 10.

In the second embodiment, each of the connecting structures 70 comprises a first connecting element 72 comprising a projecting portion which is attached to and extends from either the top 14 or the bottom 16 of the core 12, and each of the second connecting elements 74 comprises a receiving portion integrally formed in the top wall 36 or bottom wall 38 of the housing 34.

Figure 10:
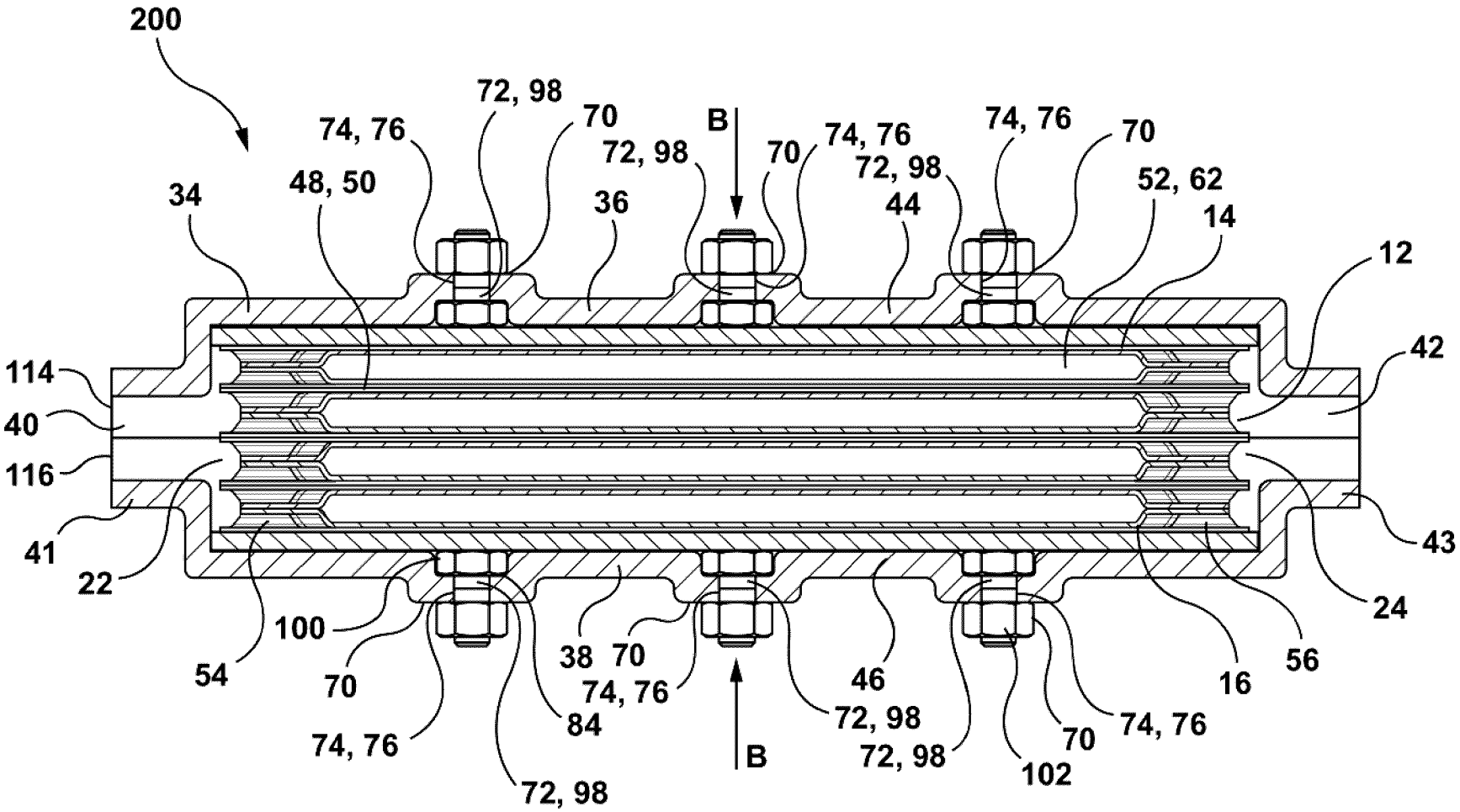
FIG. 10 is a longitudinal cross-section through a heat exchanger according to a second embodiment.
Figure 11:
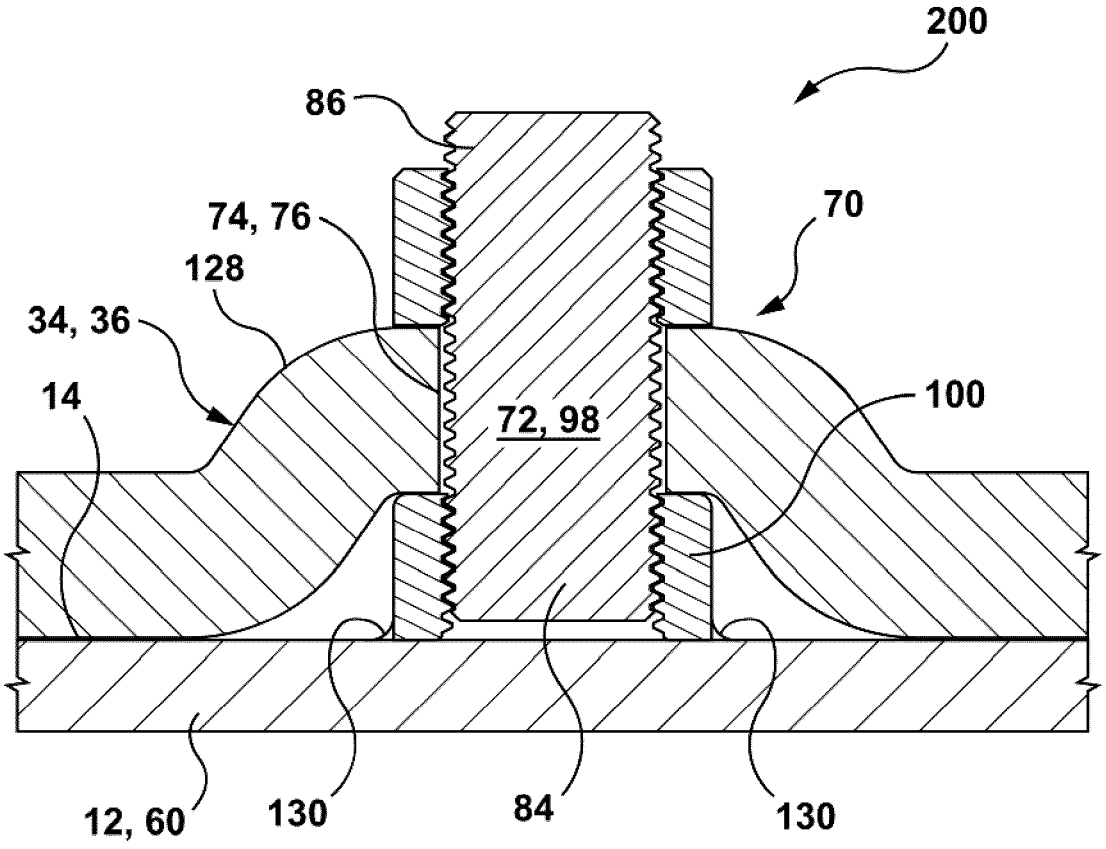
FIG. 11 is an enlarged cross-section through one of the connecting structures of the heat exchanger of FIG. 10.

With specific reference to FIGS. 10 and 11, each of the first connecting elements 72 comprises an elongate, threaded metal stud 98 projecting from one of the bottom plate 58 or top plate 60. Each of the second connecting elements 74 comprises an aperture 76 through the top wall 36 or the bottom wall 38 of the housing 34.

Each stud 98 has a first end 84 which is secured to either the bottom plate 58 or top plate 60, for example by threading the first end 84 into a nut 100 which is welded or brazed to the bottom plate 58 or top plate 60, with FIG. 11 showing braze fillets 130 at the base of nut 100. Each stud 98 also has a second threaded end 86 which extends completely through one of the apertures 76 and is secured by a nut 102.

The housing 34 of heat exchanger 200 is assembled over the core 12 in a similar manner as described above in relation to heat exchanger 10. In particular, with the studs 98 attached to the bottom plate 58 and top plate 60 as shown in FIG. 10, and with the core 12 situated between the top and bottom segments 44, 46 of housing 34 as in FIG. 3, the segments 44, 46 are spaced apart from one another along an assembly axis B, with the top 14 of core 12 facing the top wall 36 of housing 34, and the bottom 16 of core 12 facing the bottom wall 38 of housing 34. The housing 34 is assembled over the core 12 by moving at least one of the first and second segments 44, 46 toward one another along the assembly axis B. The movement of segments 44 and/or 46 toward one another is continued until the segments 44 and 46 are brought into engagement with one another along their respective connecting flanges 114, 116, and until the threaded second end 86 of each stud 98 extends completely through one of the apertures 76. At this point the nuts 102 are threaded onto the second ends 86 of studs 98 to provide rigid connections between the top 14 of the core 12 and the top wall 36 of housing 34, or between the bottom 16 of the core 12 and the bottom wall 38 of housing 34, so as to provide the benefits discussed above for heat exchanger 10.

Once the connecting flanges 114, 116 of the segments 44, 46 are in engagement with one another, they may be sealingly joined together by any suitable means, such as mechanically or by welding, in addition to the mechanical connection provided by studs 98 and nuts 102. Each of the connecting structures 70 provides a connection between the top 14 of the core 12 and the top wall 36 of housing 34, or between the bottom 16 of the core 12 and the bottom wall 38 of housing 34. The added structural rigidity provided by connecting structures 70 provides support for the top wall 36 and bottom wall 38 of the housing 34, providing the advantages discussed above.

In heat exchanger 200 it can be seen that the nuts 100 are received in protrusions 128 in the top and bottom walls 36, 38 of housing 34, and the top and bottom walls 36, 38 are in substantial contact with the respective top plate 60 and bottom plate 58 of core 12. In this case it may be unnecessary to provide a bypass blocking seal (similar to seal 27), at least along the top 14 and bottom 16 of core 12. However, it will be appreciated that the top and bottom walls 36, 38 of housing 34 may be spaced from the respective top and bottom 14, 16 of core 12, as in heat exchanger 10, in which case a seal such as seal 67 may be provided to block bypass flow.

A heat exchanger 300 according to a third embodiment is now described below with reference to FIGS. 12 to 16. Heat exchanger 300 includes a number of elements in common with heat exchangers 10 and 200 described above. These like elements are identified with like reference numerals, and the above description of these like elements in connection with heat exchanger 10 and/or 200 applies equally to the elements of heat exchanger 300, unless otherwise indicated.

The core 12 of heat exchanger 300 is similar or identical to the core 12 of heat exchanger 10 described above, except that the bottom plate 58 and top plate 60 are joined to the turbulence-enhancing inserts 62 of the lowermost and uppermost first fluid flow passages, rather than to the tubes or plate pairs 48. However, this difference is not significant for the present discussion, and heat exchanger 300 may be provided with a core construction identical to that of heat exchanger 10, except as noted below. For convenience, the drawings do not show any manifolds or an inlet or outlet opening for the second fluid, but it will be appreciated that these will be present in the core 12 of heat exchanger 300.

Heat exchanger 300 includes a housing 34 comprising a first segment 44 and a second segment 46 which are sealingly joined together along their respective connecting flanges 114, 116. In the present embodiment, the first segment 44 and the second segment 46 each include a portion of the top wall 36 and a portion of the bottom wall 38 of housing 34. For convenience, the housing 34 of heat exchanger 300 is shown in the drawings without any inlet or outlet openings for the first fluid and the second fluid, nor do the drawings show inlet or outlet fittings for the second fluid. Thus, FIGS. 12 and 13 may represent either longitudinal or transverse cross-sections of heat exchanger 300.

In the third embodiment, each of the connecting structures 70 comprises first and second connecting elements 72, 74 as defined above, wherein each of the first connecting elements 72 comprises a projecting portion associated with the top 14 or the bottom 16 of the core 12, and each of the second connecting elements 74 comprises a receiving portion associated with the top wall 36 or bottom wall 38 of the housing 34.

Figure 12:
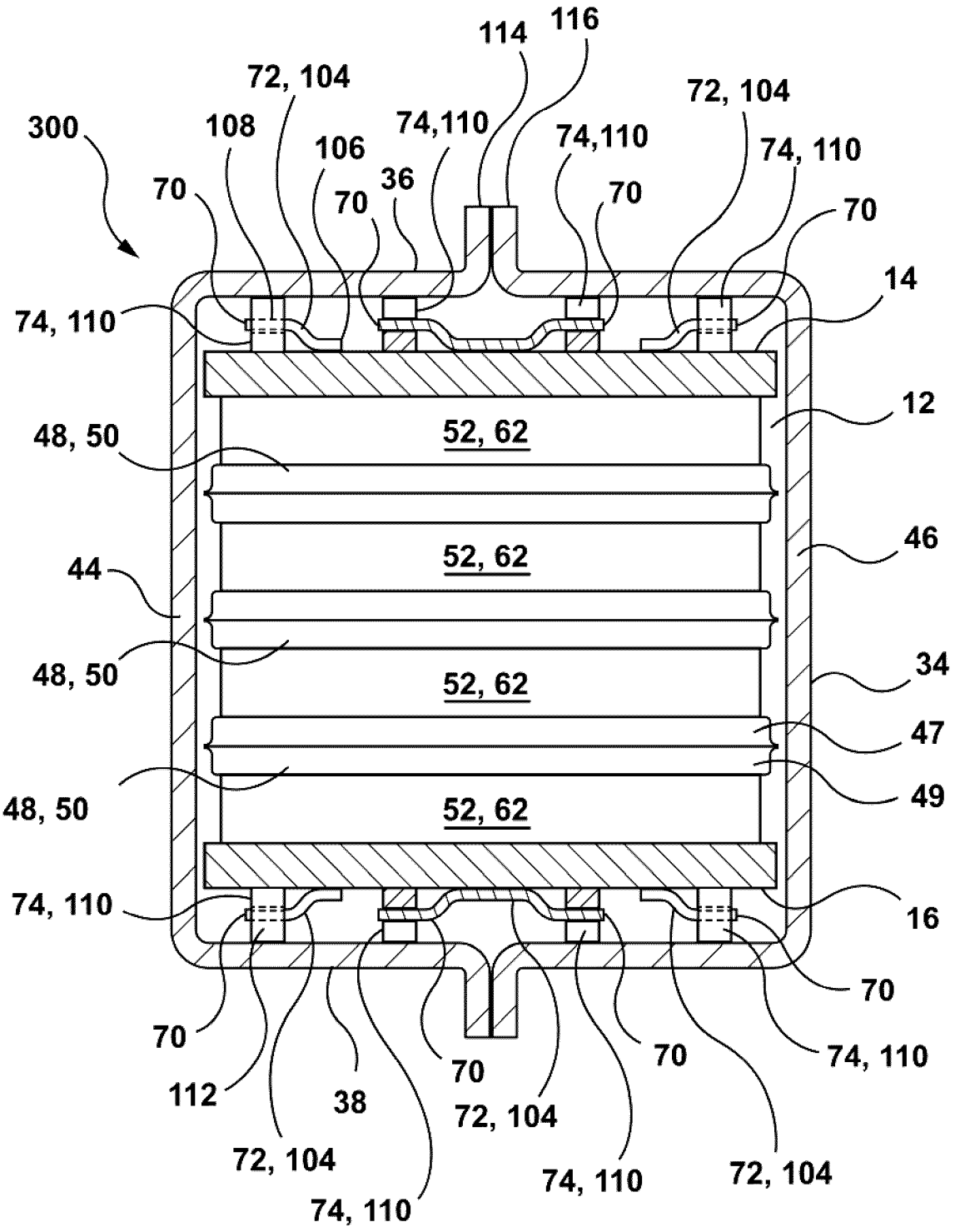
FIG. 12 is a longitudinal or transverse cross-section through a heat exchanger according to a third embodiment.
Figure 13:
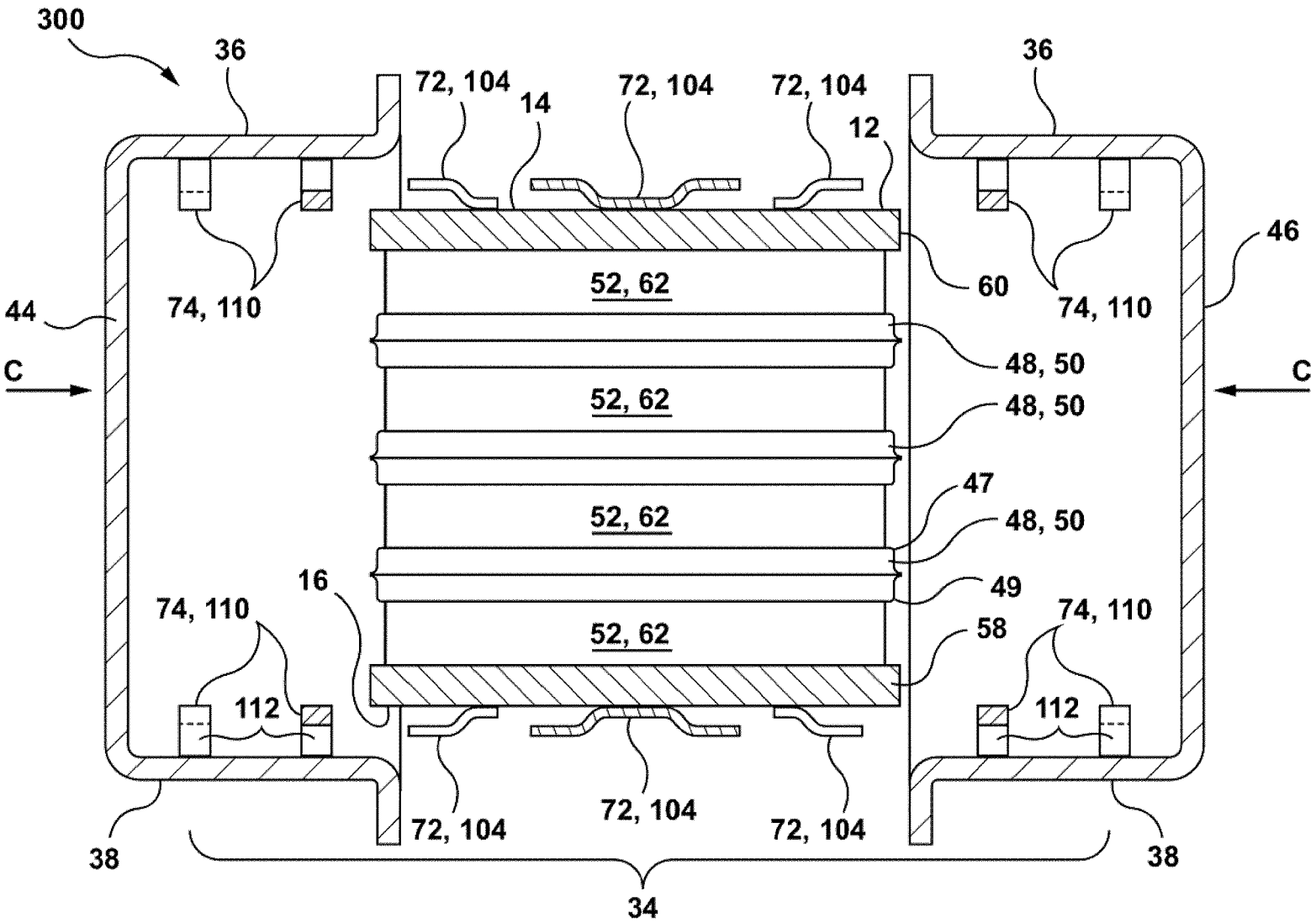
FIG. 13 is a longitudinal or transverse cross-section through the heat exchanger of FIG. 12, showing the assembly of the housing over the core.
Figure 14:
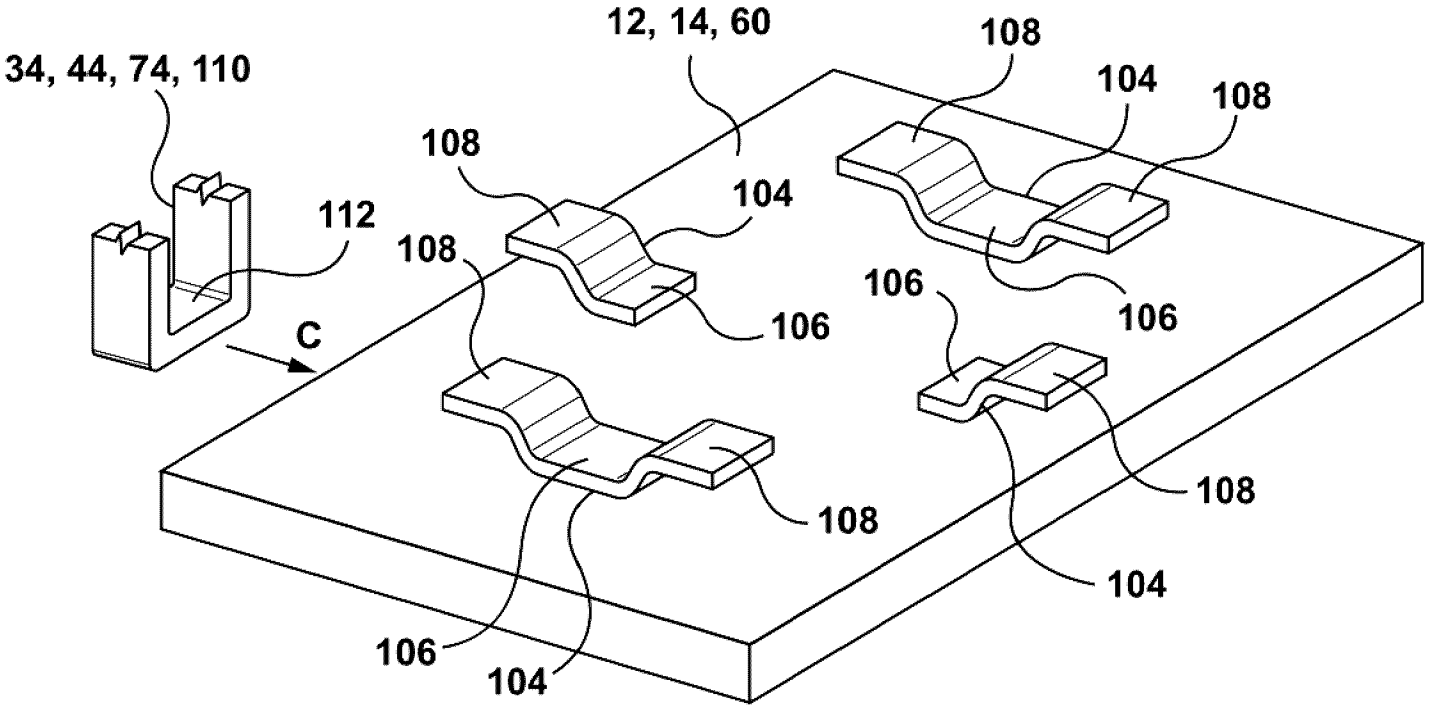
FIGS. 14 to 16 are explanatory views showing the connecting structures of the heat exchanger of FIG. 12.

With specific reference to FIGS. 12 to 16, each of the first connecting elements 72 comprises a tab 104 having a first portion 106 secured to either the bottom plate 58 or top plate 60 of core 12, for example by brazing or welding (braze fillets 130 shown in FIGS. 15 and 16), and at least one free end 108 which is oriented substantially parallel to the bottom plate 58 or top plate 60 and spaced therefrom. As shown in FIG. 14, the free ends 108 of the tabs 104 are each directed toward an outer edge of plate 58 or 60.

Each of the second connecting elements 74 comprises a slotted projection 110 extending from the top wall 36 or the bottom wall 38 of the housing 34 toward the core 12. In the present embodiment, the slotted projections 110 are U-shaped, and include a slot 112 in which the free ends 108 of tabs 104 are received. The slotted projections 110 may either be integrally formed with the top and bottom walls 36, 38 of housing or they may be separately formed and attached thereto by any suitable means, such as by welding and/or by mechanical attachment.

The heat exchanger 300 is assembled by placing the core 12 between the segments 44, 46 in the orientation shown in FIG. 13, i.e. with the top and bottom 14, 16 (defined by plates 58, 60) of core 12 being in parallel spaced relation to the portions of the top and bottom walls 36, 38 in the segments 44, 46 of housing 34. The housing 34 is assembled over the core 12 by moving at least one of the first and second segments 44, 46 toward one another along an assembly axis C which is parallel to the top and bottom plates 60, 58, and parallel to the free ends 108 of the tabs 104. The movement of segments 44 and/or 46 toward one another is continued until the segments 44 and 46 are brought into engagement with one another along their respective connecting flanges 114, 116, and until each of the first connecting elements 72 of the core 12 is brought into engagement with and secured to one of the second connecting elements 74 of the housing 34. The first and second connecting elements 72, 74 are arranged such that the free ends 108 of the tabs 104 will be fully engaged and secured in the slots 112 of the slotted projections 110 when the connecting flanges 114, 116 of the segments 44, 46 are in engagement with one another. No deformation of the free ends 108 of tabs 104 is necessary to keep them in engagement with slotted projections 110 once the segments 44, 46 of housing 34 are sealingly joined together.

Once the connecting flanges 114, 116 of the segments 44, 46 are in engagement with one another, they may be sealingly joined together by any suitable means, such as mechanically or by welding. With the flanges 114, 116 joined and the first and second connecting elements 72, 74 secured together, the connecting structures 70 provide rigid connections between the top wall 36 of housing 34 and the top 14 of core 12, and between the bottom wall 38 of housing 34 and the bottom 16 of core 12. The added structural rigidity provided by connecting structures 70 provides support for the top wall 36 and bottom wall 38 of the housing 34, providing the advantages discussed above.

In FIG. 12 it can be seen that top and bottom walls 36, 38 of housing are spaced from the respective top plate 60 and bottom plate 58 of core 12. Therefore, it may be desirable to provide a bypass blocking seal (similar to seal 27), at least along the top 14, bottom 16 and sides of core 12.

FIG. 14 is an explanatory view showing the possible spacing of the tabs 104 across the top plate 60, and shows one of the slotted projections 110 to be engaged with one of the free ends 108 of the tab closest to the front edge of plate 60.

Figure 15:
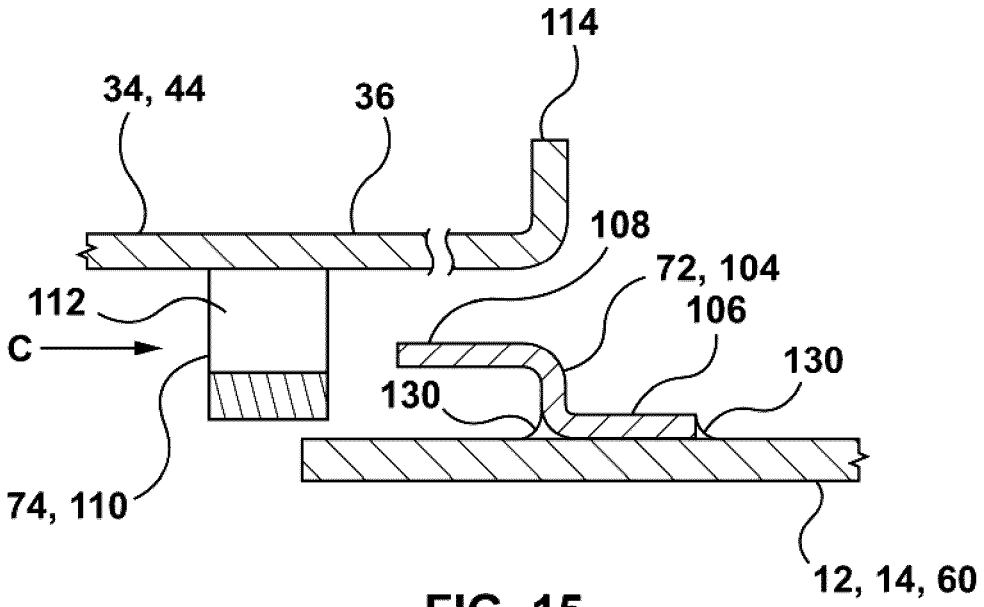
Figure 16:
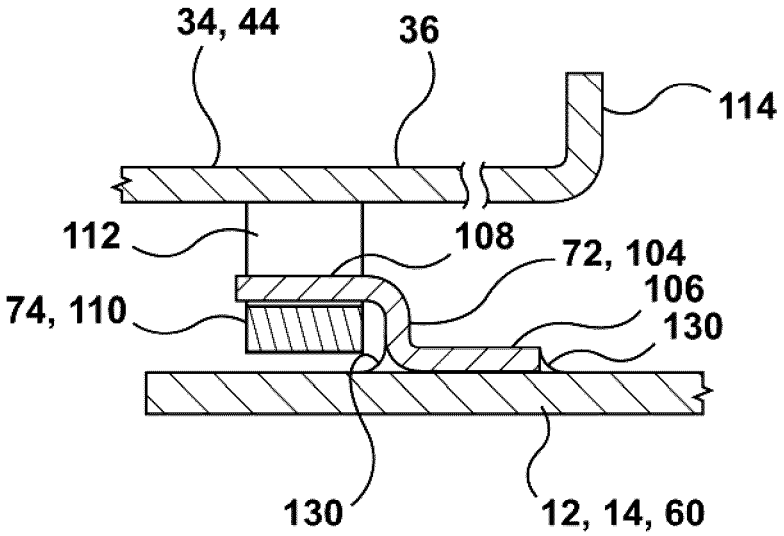

FIG. 15 shows the relative movement of a slotted projection 110 and a tab 104 relative to one another along assembly axis C, until the free end 108 of tab 104 is fully inserted and secured inside the slot 112 of the slotted projection 110.

Although the invention has been described in connection with certain embodiments, it is not limited thereto. Rather, the invention includes all embodiments which may fall within the scope of the following claims.

What is claimed is:

1. A heat exchanger comprising:

(a) a core defining a plurality of first fluid flow passages and a plurality of second fluid flow passages arranged in alternating order, wherein the core is comprised of metal and has a top and a bottom;

(b) a housing enclosing the core, the housing having a top wall arranged opposite to the top of the core, and a bottom wall arranged opposite to the bottom of the core, wherein at least the top wall and the bottom wall of the housing are comprised of plastic;

(c) a plurality of connecting structures which together provide a connection between the core and the housing, wherein each of the connecting structures provides a connection between the top of the core and the top wall of the housing, or between the bottom of the core and the bottom wall of the housing;

wherein each of the connecting structures comprises a first connecting element and a second connecting element, wherein the first connecting element is associated with the core and the second connecting element is associated with the housing;

wherein the first and second connecting elements each comprise either a projecting portion or a receiving portion, wherein the top of the core is defined by a top plate and the bottom of the core is defined by a bottom plate, and wherein each of the receiving portions comprises a recess or aperture in either the top plate or the bottom plate, wherein each said recess or aperture is undercut so as to increase in area in a direction from the top wall or bottom wall of the housing toward the opposed top or bottom of the core.

2. The heat exchanger according to claim 1, wherein the projecting portion is received in the receiving portion.

3. The heat exchanger according to claim 1, wherein the projecting portion and the receiving portion are secured together.

4. The heat exchanger according to claim 1, wherein each of the receiving portions comprises an aperture through the top plate or the bottom plate.

5. The heat exchanger according to claim 1, wherein the core comprises a plurality of plate pairs, each of the plate pairs defining one of said second fluid flow passages and comprising a first core plate and a second core plate, the plate pairs being separated by spaces which define said first fluid flow passages, said first fluid flow passages having an inlet and an outlet; and wherein said housing has a first fluid inlet opening and a first fluid inlet manifold to supply the first fluid to the inlet of the first fluid flow passages, and the housing has a first fluid outlet opening and a first fluid outlet manifold to receive the first fluid from the outlet of the first fluid flow passages.

6. The heat exchanger according to claim 5, wherein the top plate and the bottom plate are each thicker than one of the core plates.

7. The heat exchanger according to claim 6, wherein the housing comprises a plurality of segments.

* * * * *